US006391157B1

(12) United States Patent
Elger

(10) Patent No.: US 6,391,157 B1
(45) Date of Patent: May 21, 2002

(54) DEVICE AND PROCESS FOR PRODUCING A PAPER WEB

(75) Inventor: Hanspeter Elger, Mülheim (DE)

(73) Assignees: Stora Publication Paper AG, Dusseldorf; Voith Sulzer Papiertechnik Patent GmbH, Heidenheim, both of (DE)

( * ) Notice: Subject to any disclaimer, the term of this patent is extended or adjusted under 35 U.S.C. 154(b) by 0 days.

(21) Appl. No.: 09/447,859

(22) Filed: Nov. 23, 1999

(30) Foreign Application Priority Data

Dec. 7, 1998 (DE) ..... 198 56 277

(51) Int. Cl.[7] ..... D21F 1/36; D21F 11/16

(52) U.S. Cl. ..... 162/194; 162/286; 162/193; 226/109

(58) Field of Search ..... 162/120, 123, 162/132, 193, 194, 197, 198, 255, 260, 269, 285, 286, 287, 300, 301, 304, 305, 306, 315, 326, 327, 343, 348, 353; 226/92, 109; 493/340

(56) References Cited

U.S. PATENT DOCUMENTS 702,205 A * 6/1902 Hanscom ..... 162/194
1,545,634 A * 7/1925 Bird ..... 162/194
3,655,475 A * 4/1972 Stelling, Jr. et al. ..... 156/197
3,732,763 A * 5/1973 Smuda ..... 83/98
4,139,411 A * 2/1979 Johnsen ..... 162/123
4,368,879 A * 1/1983 Hoshi ..... 270/6
4,818,343 A * 4/1989 Laine ..... 162/286
4,846,033 A * 7/1989 Uehlinger et al. ..... 83/94
5,062,582 A * 11/1991 Harmon et al. ..... 242/56.4

FOREIGN PATENT DOCUMENTS

DE 19519011 5/1996 ..... D21G/1/00

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

A method and apparatus for producing a web. The apparatus includes a machine for providing a web having an output end at least one refining device arranged in a region of the output end and a longitudinal cutting device located at the output end. In this manner, the web is cut into web strips. The method includes feeding a web, cutting the web into longitudinal sections, and refining the longitudinal sections.

26 Claims, 1 Drawing Sheet

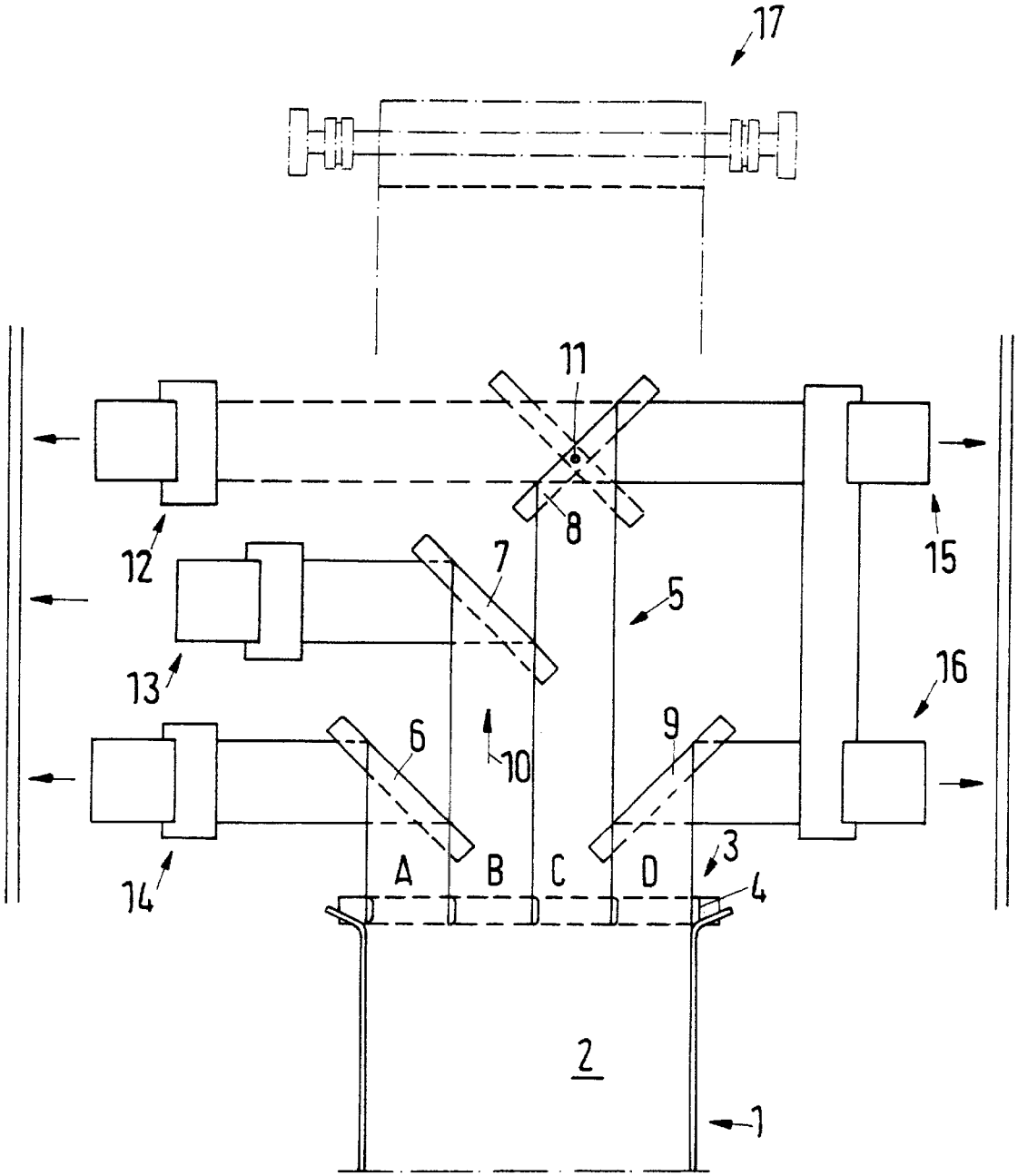
17
11
8
12
7
15
5
13
16
6
10
9
14
A
B
C
D
3
4
2
1

DEVICE AND PROCESS FOR PRODUCING A PAPER WEB

CROSS-REFERENCE TO RELATED APPLICATIONS

The present application claims priority under 35 U.S.C. §119 of German Patent Application No. 198 56 277.2, filed on Dec. 7, 1998, the disclosure of which is expressly incorporated by reference herein in its entirety.

BACKGROUND OF THE INVENTION

1. Field of the Invention

The invention concerns a device for producing a paper web which incorporates a paper machine and at least one refining device. The invention also concerns a process for producing a paper web in which the paper web is formed in a paper machine and is cut into longitudinal strips, and refined.

2. Discussion of Background Information

Paper webs are being produced in ever increasing widths. In fact, the use of paper machines with working widths of less than 6 meters are becoming very rare. At the same time, paper webs are also being produced at increasingly higher speeds. For example, modern paper machines typically run at speeds greater than 1000 m/min. Even speeds of 2000 m/min. are being attempted. These ever increasing speeds can cause significant problems in the further refining of the paper web. At this point it should be noted that the term "refining" is intended to signify processing steps which change the quality or the properties of the web. Refining is typically performed by devices such as calenders, glazers, coaters, wetting machines, dryers, and the like. This is to be contrasted with simply winding the paper web, for example, which does not have a refining effect.

Current processes for guiding such wide and fast-moving paper webs through calenders, coaters, or other processing or refining machines require a considerable expenditure of equipment and time as well as sophisticated control technology. Moreover, it has been found that the more complex the control, the more difficult it becomes to make changes in the path of the web.

SUMMARY OF THE INVENTION

The invention therefore provides for increased flexibility in the production of paper.

This is accomplished with a device similar in general to the type mentioned in the introduction which also utilizes a web cutting device located at the outlet of the paper dispenser.

A raw paper web is initially cut into several strips that have smaller widths than the raw web. These strips may have any desired width. It has been discovered that these narrower strips are easier to handle when being processed or refined, especially when they are handled at the typical running speeds disclosed above. Accordingly, because of this ease of handling, these narrower strips can be guided more effectively, which allows for flexibility in designating different web paths. Moreover, providing different paths for processing the strips means that it is no longer a requirement that all the strips be further processed or refined in the same manner. Consequently, even when using the more efficient wide paper machines, it becomes possible to manufacture paper in smaller lot sizes, with the desired quality characteristics.

Another advantage to processing these narrower strips is that it is possible to keep the properties of a narrower paper web more constant across their widths. Accordingly, the quality of the paper webs produced in this way can be improved. Although the longitudinal cutting of paper webs is already known per se, this cutting has conventionally only occurred as the last step in the production process, i.e., typically just before the winding of the paper webs into marketable reels. Thus, the conventional paper web underwent all refining and processing across its entire width prior to it being cut into strips. Processing paper in the way requires sophisticated and expensive handling, which can be avoided by simply placing the cutting before the beginning of the "refining" as per the instant invention.

Of course, the invention contemplates the use of, many identical processing machines, such as calenders or the like for the actual refining. The use of standard machines with standard processing widths is also contemplated. One advantage of the smaller standard machines is that they are delivered fully assembled. Another advantage is that they consume less energy. In certain circumstances, it may even be possible to guide several paper web strips next to each other through a common refining machine.

The present invention can also provide a turning arrangement which essentially causes a directional change in the plane of the paper web. This turning arrangement is located downstream from the longitudinal cutting device. With such a turning arrangement, it is possible to direct the paper web strips for further processing by machines which need not necessarily be located in a straight line with respect to the paper machine or raw paper dispenser. Such an arrangement allows for greater flexibility in the use of production facilities and equipment layout. It may also be desirable to deviate from the typical path of web travel, i.e., horizontal, so that the strips may be turned, e.g., upward or downward. However, such web paths may require a relatively tall structural height of the manufacturing building or deep basements if a plurality of processing machines are to be arranged, for example, one above another. However, when an essentially horizontal path is utilized, i.e., the typical plane of the paper web, the downstream machines can then be arranged on the same "level."

Ideally, the output direction of the turning arrangement should be variable, i.e., the angle of the turning is adjustable. The turning arrangement can function as a sort of "switch", which can turn the paper web selectively in one of a plurality of output directions. Accordingly, the paper web would then be allowed to pass through one of a plurality of processing devices or machines.

In a particular embodiment, processing devices of at least two different types are utilized and located downstream from the turning arrangement, in the desired direction of travel of the narrower strips. This would allow each of the longitudinal strips to be processed in at least two different ways, for example. One could control the type of processing the strip will experience by the selected output direction of the turning arrangement. Such a design would permit very flexible adaptation of paper web strip processing.

In the exemplary embodiment, a first group of processing devices is arranged in a first direction downstream from the turning arrangement and a second group of processing devices, also arranged downstream from the turning arrangement, in a second direction. This design would permit, for example, the processing of all strips in the same type of processing devices, if so desired. Additionally, this design allows for the guiding of individual paper web strips in other directions, upon leaving the turning arrangement, and accordingly, allows for processing the strips differently by simply turning them in the direction of the processing type.

Moreover, a third group of processing devices can also be arranged in a third direction downstream from the turning arrangement.

For the sake of simplicity, the term "turn" should be broadly construed to mean that the paper web strips can also run in a straight line through the turning arrangement, i.e., the turning arrangement can be set to allow for straight through processing. It is possible to arrange a plurality of different groups of processing devices, for example, calenders, coaters, or winders, downstream from the turning arrangement. The invention contemplates a relatively large matrix of potential applications and downstream equipment layouts.

As explained above in connection with the device, the process provides for further processing the relatively narrow paper web strips efficiently. This is because the handling of narrower strips makes for a simpler process.

The invention provides for the paper web to be cut into longitudinal strips at the output of the paper machine. After they are cut, the strips are available for turning and further processing.

The "outlet" of the paper machine, as this term is used here, is intended to mean any point at which the paper web can be cut and further processed. This point may even lie upstream from or in the drying section of a typical paper machine.

The instant invention further contemplates that the longitudinal strips are selectively turned substantially parallel to their flat surface in one of a plurality of directions. This configuration has the advantage that the paper web strips can be fed to different processing devices which are arranged substantially in the same horizontal plane as the paper machine or its output. However, vertical arrangements may also be desirable depending on the building design.

According to one aspect of the invention there is provided an apparatus for producing a web, which includes a machine for providing a web having an output end at least one refining device arranged in a region of the output end and a longitudinal cutting device located at the output end. In this manner, the web is cut into web strips.

The apparatus further includes at least one refining device located downstream from the output end. The cutting device cuts the paper web into a plurality of paper web strips for processing by the at least one refining device.

The apparatus may additionally have at least one turning arrangement arranged downstream of the cutting device relative to a web running direction. The turning arrangement can be positioned to change a direction of travel of the web within a same plane of travel. The at least one turning arrangement may be located between the cutting device and the at least one refining device, such that the turning arrangement is capable of changing the direction of at least one web strip for delivery to the at least one refining device. Additionally, the direction of travel is variable by the turning arrangement, and can be turned in a direction which is substantially perpendicular to the travel direction. Further, the at least one refining device can be positioned to receive one of the turned strips.

According to another aspect of the invention, the apparatus includes a plurality of refining devices. The plurality of refining devices may include at least two different types of devices which provide different treatments to the web strips. The plurality of refining devices may further include at least two groups of refining devices located in different travel directions from the turning arrangement. The refining devices may include a first group of refining devices arranged in a first direction from the turning arrangement, and a second group of refining devices arranged in a second direction from the turning arrangement. The plurality of refining devices may further include a third group of refining devices arranged in a third direction from the turning arrangement. Additionally, the first, second, and third directions are separated by approximately 90°. Moreover, at least some of the strips may be turned in directions which are substantially perpendicular to the travel direction, and the at least one refining device can include a plurality of refining devices in which some of the plurality of refining devices are positioned to receive the turned strips.

According to another aspect of the invention, the apparatus includes a machine which is a paper making machine. Alternatively or additionally, the machine can include a wound roll. Moreover, the web may be a paper web According to another aspect of the invention, the apparatus includes a longitudinal cutting device which includes a plurality of cutting devices which are positionably adjustable to change the widths of the web strips.

According to another aspect of the invention, at least one refining device can include at least one of a calender, a coater, and a winder.

The invention is also directed to a method of producing a web which includes feeding a web, cutting the web into longitudinal sections, and refining the longitudinal sections. The cutting may be performed at an output of a machine for feeding the web. The machine may include a paper machine having an output end, wherein the cutting can be performed between the output end and the refining of the longitudinal sections. The method may further include turning the longitudinal strips prior to refining. The turning can be performed by a turning arrangement located between a cutting device and a refining area.

According to another aspect of the invention, the method provides for the turning to further include selectively turning at least one of the longitudinal sections in a direction different than a web running direction. The at least one selectively turned longitudinal section may run in a plane substantially parallel to the web running direction.

According to another aspect of the invention, the method may provide for changing a width of the longitudinal sections. The turning of at least one of the longitudinal sections may be in a direction different than a web running direction. Moreover, the different direction may be approximately 90° from the web running direction.

According to another aspect of the invention, the refining comprises refining in at least one of a calender, a coater, and a winder. Further, the web may be a paper web.

According to another aspect of the invention, there is provided an apparatus for producing a web, which includes a paper machine for providing a paper web from an output end in a travel direction, at least one refining device located at a downstream distance from the output end, a longitudinal cutting device located between the paper machine output end and the at least one refining device, and at least one turning arrangement located between the cutting device and the at least one refining device for directing the direction of travel of the web strips toward the at least one refining device. The cutting device cuts the paper web into a plurality of paper web strips for processing by the at least one refining device.

According to still another aspect of the invention, there is provided a method of producing a web, which includes making a paper web using paper making machine, cutting the web into strips at an output end of a paper making machine, turning the strips in a direction of a refining area, and refining the strips.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

The FIGURE shows a top view of the output of the paper machine with downstream processing devices.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A paper machine 1, as a raw paper dispenser, typically produces a raw paper web 2 at its output 3 end. The raw paper web 2 has a typical width in the range of e.g., approximately 6 to 10 meters but can be even greater, depending on the type of machine used. However efficient it may be to make paper in such widths, these wide webs have proven to be very difficult to handle. This is especially true when the raw paper web is dispensed at a relatively high speed, such as on the order of, e.g., more than approximately 1000 m/min.

To make handling easier, the invention provides for a longitudinal cutting device 4 which cuts raw paper web 2 into a plurality of paper web strips. In the exemplary embodiment, four paper web strips A, B, C, D or longitudinal strips, are arranged at the output 3 of paper machine 1, however, it is noted that any number of strips can be formed and utilized. Of course, the width of each paper web strip is less than the width of the raw paper web 2. As a result, paper web strips A–D are easier to handle and refine.

Moreover, the invention also contemplates that longitudinal cutting device 4 can simultaneously also perform edge trimming.

The invention also provides a turning arrangement 5 which has turning rolls 6–9, also called a "web turn", such that one turning roll can be provided for each paper web strip A–D downstream from longitudinal cutting device 4.

In the exemplary turning arrangement shown, each turning roll 6–9 turns the associated paper web strips A–D essentially at a right angle with respect to the dispensing path. Further, downstream from longitudinal cutting device 4, paper web strips A–D run parallel to the dispensing path as they approach turning rolls 6–9. Turning rolls 6–9 are arranged to redirect the strips in the desired direction, e.g., substantially perpendicular to the dispensing path. For this purpose, turning rolls 6–9 are arranged at an angle of approximately 45° relative to travel direction 10 of paper web strips A–D.

As depicted on turning roll 8, turning rolls 6–9 can be designed to be pivotable around a substantially vertical axis 11. For reasons of clarity, this pivoting capability is not depicted for turning rolls 6, 7, 9, but the instant invention contemplates such an arrangement. The invention also contemplates other strip turning designs (not shown) which can redirect the strips in the desired direction for further processing. In the position of turning roll 8 depicted with solid lines, the approaching paper web strip C, which is also depicted by solid lines, is turned to the right. However, in the angular position of turning roll 8 depicted with broken lines, approaching paper web strip C is turned to the left. Moreover, if the rotational axis of the turning roll 8 (not shown) is aligned substantially perpendicular to travel direction 10 of paper web strip C, then no change in direction occurs in the plane of the paper web strip, i.e., the strip can continue to travel as straight as when it exited the cutter. In this case, the paper web strip C can pass straight through turning arrangement 5 without being turned. In any event, this process is still referred to as turning. Further still, when the rotational axis of turning roll 8 is substantially perpendicular to travel direction 10, turning roll 8 can be utilized to deflect web strip C in a vertically upward or downward direction if desired.

Thus, it is possible to dispense paper web strips A–D in at least three different major directions using turning arrangement 5 such that adjacent directions are spaced by approximately 90°. Of course other angular arrangements are also possible, depending on where the processing and refining equipment is located.

Accordingly, the invention contemplates arranging the processing devices, for further processing of the paper web, on at least the three major sides of turning arrangement 5 (a fourth major side being occupied by paper machine 1). The processing devices can, for example, be arranged such that a group of identical processing devices is always located on one side of the turning arrangement, whereas the processing devices on another side differ therefrom. Accordingly, it is possible to select different processing or refining steps for the paper web strips A–D by simply choosing the direction in which paper web strips A–D are turned. This arrangement can provide particular flexibility when all paper web strips A–D which are cut from the same raw paper web 2, do not have to be processed identically. For example, in the turning arrangement shown, paper web strips A, B can be turned to the left to pass through one type of processing arrangement, while paper web strips C, D can be turned to the right to pass through a different type of processing arrangement.

The width of the processing devices connected downstream from the turning arrangement 5 should be adapted to handle the width of paper web strips A–D. However, because strip A–D are smaller than raw web 2, these processing devices may also be smaller and significantly narrower than the typical working width of paper machine 1. Accordingly, these smaller standard machines, utilizing the standard widths, may be used more effectively. The advantage of smaller standard machines is that they can be easily positioned, they come fully assembled, and they generally consume less energy. Thus, the invention provides for a more flexible and efficient set up. Based on the cutting of raw paper web 2 into individual paper web strips or longitudinal strips A–D, it also becomes practicable to produce paper in smaller lot sizes, which allows one to process one portion of raw paper web 2 differently from another portion.

In the embodiment shown, three processing devices, e.g., calenders 12–14 can be provided on the left side, while two processing machines, e.g., coaters 15, 16 can be provided on the right side. Of course, any number of machines or devices can be arranged on the respective sides and directions depending on the requirements of the manufacturer.

If, for example, raw paper web 2 is allowed to pass straight through turning arrangement 5 after cutting, it can also pass through a third refining device 17. Raw paper web 2 may be cut, for example, into two longitudinal strips. One is free to choose the different widths in determining the cutting plan and further processing. For example, the paper web strips can be allowed to run through refining device 17 side by side.

The invention also contemplates that instead of the calenders or coaters, which are described, other processing devices, e.g., dryers or the like, may be provided anywhere and in any direction after. turning arrangement 5. In such cases, raw paper web 2 can be taken from positions in the paper machine where the raw paper does not yet have the desired final moisture, for example.

Furthermore, in the case of the typical 6-m paper machine, two processing devices each having 4-m width capabilities can be used. This would allow for any web widths between 2 and 4 m approximately to be processed. Thus, one strip might pass through a calender and then be rolled, while another strip may not be calendered, but simply rolled. Overall, any number of possible configurations are contemplated by the instant invention.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An apparatus for producing a paper web, comprising:

a paper machine for providing the paper web, the paper machine having an output end;

at least one refining device arranged in a region of the output end; and a longitudinal cutting device located at the output end, wherein the paper web is cut into web strips, and wherein the direction of travel is variable by at least one turning arrangement, the at least one turning arrangement being able to direct the web strips in various directions.

2. The apparatus of claim 1, wherein said at least one refining device is located downstream from said output end, and wherein the longitudinal cutting device cuts the paper web into a plurality of paper web strips, at least one of the paper web strips being processed by the at least one refining device.

3. The apparatus of claim 1, wherein the at least one turning arrangement is arranged downstream of the longitudinal cutting device relative to a web running direction, and wherein the at least one turning arrangement is positioned to change a direction of travel of the web within a same plane of travel.

4. The apparatus of claim 3, wherein the at least one turning arrangement is located between the longitudinal cutting device and the at least one refining device, such that the at least one turning arrangement is capable of changing the direction of at least one web strip for delivery to the at least one refining device.

5. The apparatus of claim 1, wherein said at least one refining device comprises a plurality of refining devices.

6. The apparatus of claim 5, wherein said plurality of refining devices comprise at least two different types of devices which provide different treatments to the web strips.

7. The apparatus of claim 1, wherein the longitudinal cutting device comprises a plurality of cutting devices which are positionably adjustable to change the widths of the web strips.

8. The apparatus of claim 1, wherein the at least one refining device comprises at least one of a calender, a coater, a glazer, a wetting machine, and a dryer, and wherein at least one of the web strips is adapted to be wound onto a winder.

9. An apparatus for producing a paper web, comprising:

a paper machine for providing the paper web, the paper machine having an output end;

at least one refining device arranged in a region of the output end; and a longitudinal cutting device located at the output end, wherein the paper web is cut into web strips, wherein a direction of travel of at least one of the web strips is variable by at least one turning arrangement, wherein at least one of the web strips are turned in a direction which is substantially perpendicular to the travel direction, and wherein the at least one refining device is positioned to receive one of the turned web strips.

10. An apparatus for producing a paper web, comprising:

a paper machine for providing the paper web, the paper machine having an output end;

at least one refining device arranged in a region of the output end;

a longitudinal cutting device located at the output end; and at least one turning arrangement, wherein the paper web is cut into web strips, wherein said at least one refining device comprises a plurality of refining devices, and wherein the plurality of refining devices further comprise at least two groups of refining devices located in different travel directions from the at least one turning arrangement.

11. An apparatus for producing a paper web, comprising:

a paper machine for providing the paper web, the paper machine having an output end;

at least one refining device arranged in a region of the output end;

a longitudinal cutting device located at the output end; and at least one turning arrangement, wherein the paper web is cut into web strips, wherein said at least one refining device comprises a plurality of refining devices, and wherein the plurality of refining devices further comprise a first group of refining devices arranged in a first direction from the at least one turning arrangement, and a second group of refining devices arranged in a second direction from the at least one turning arrangement.

12. An apparatus for producing a paper web, comprising:

a paper machine for providing the paper web, the paper machine having an output end;

at least one refining device arranged in a region of the output end;

a longitudinal cutting device located at the output end; and at least one turning arrangement, wherein the paper web is cut into web strips, wherein said at least one refining device comprises a plurality of refining devices, and wherein the plurality of refining devices further comprise a third group of refining devices arranged in a third direction from the at least one turning arrangement.

13. The apparatus of claim 12, wherein the first, second, and third directions are separated by approximately 90°.

14. The apparatus of claim 12, wherein at least some of the web strips are turned in directions which are substantially perpendicular to a travel direction, and the plurality of refining devices are positioned to receive the turned web strips.

15. An apparatus for producing a paper web, comprising:

a paper machine for providing the paper web from an output end in a travel direction;

at least one refining device located at a downstream distance from the output end;

a longitudinal cutting device located between the paper machine output end and the at least one refining device; and at least one turning arrangement located between the cutting device and the at least one refining device for directing the direction of travel of the web strips toward the at least one refining device, wherein the longitudinal cutting device cuts the paper web into a plurality of paper web strips for processing by the at least one refining device, and wherein the direction of travel is variable by the at least one turning arrangement, the at least one turning arrangement being able to direct the web strips in various directions.

16. An apparatus for producing a paper web, comprising:

a machine for making the paper web;

a longitudinal cutting device for cutting the paper web into web strips;

at least one turning arrangement arranged downstream of the longitudinal cutting device relative to a paper web running direction;

the at least one turning arrangement being positioned to change a direction of travel of at least one of the web strips; and at least one refining device arranged downstream of the at least one turning arrangement, wherein the at least one turning arrangement is adapted to direct one of the web strips to the at least one refining device.

17. A method of producing a paper web, comprising:

making the paper web in a paper machine;

feeding the paper web to an output end of the paper machine;

cutting the paper web into longitudinal sections with a longitudinal cutting device after the paper web exits the output end; and refining at least one of the longitudinal sections, wherein a direction of travel of the longitudinal sections is varied by at least one turning arrangement, the at least one turning arrangement being able to direct at least one of the longitudinal sections in a direction other than a paper web running direction.

18. The method of claim 17, further comprising:

turning at least one of the longitudinal strips prior to refining;

wherein the turning is performed by the at least one turning arrangement located between the longitudinal cutting device and a refining area.

19. The method of claim 18, wherein the turning further comprises selectively turning at least another one of the longitudinal sections in a direction different than the paper web running direction.

20. The method of claim 19, wherein the at least one selectively turned longitudinal section runs in a plane substantially parallel to the paper web running direction.

21. The method of claim 17, further comprising changing a width of the longitudinal sections.

22. The method of claim 17, further comprising turning at least two of the longitudinal sections in a direction different than the paper web running direction.

23. The method of claim 22, wherein the different direction is approximately 90° from the paper web running direction.

24. The method of claim 17, wherein the refining comprises refining in at least one of a calender, a coater, a glazer, a wetting machine, and a dryer, and wherein at least one of the web strips is adapted to be wound onto a winder.

25. A method of producing a paper web, comprising:

making the paper web using paper making machine;

cutting the paper web into strips at an output end of a paper making machine;

turning the strips in a direction of a refining area; and refining the strips, wherein a direction of travel of the strips is varied by a turning arrangement, the turning arrangement being able to direct the strips in various directions.

26. A method of producing a paper web comprising:

making the paper web in a paper machine;

cutting the paper web into web strips using a longitudinal cutting device located at an output end of the paper machine;

changing a direction of travel of at least one of the web strips using at least one turning arrangement;

directing at least one of the web strips to a first refining device; and directing at least another of the web strips to a second refining device.

* * * * *